US011261511B2

(12) United States Patent
Sueyasu et al.

(10) Patent No.: US 11,261,511 B2
(45) Date of Patent: Mar. 1, 2022

(54) HOT FORGED STEEL MATERIAL

(71) Applicant: NIPPON STEEL CORPORATION, Tokyo (JP)

(72) Inventors: Yoko Sueyasu, Tokyo (JP); Hiroaki Tahira, Tokyo (JP); Ken Yoshino, Tokyo (JP); Kison Nishihara, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/758,592

(22) PCT Filed: Oct. 31, 2018

(86) PCT No.: PCT/JP2018/040570

§ 371 (c)(1),
(2) Date: Apr. 23, 2020

(87) PCT Pub. No.: WO2019/088190

PCT Pub. Date: May 9, 2019

(65) Prior Publication Data

US 2021/0189532 A1 Jun. 24, 2021

(30) Foreign Application Priority Data

Oct. 31, 2017 (JP) ..... JP2017-209869

(51) Int. Cl.

| | |
|---|---|
| ***C22C 38/38*** | (2006.01) |
| ***C22C 38/00*** | (2006.01) |
| ***C22C 38/02*** | (2006.01) |
| ***C22C 38/06*** | (2006.01) |
| ***C22C 38/20*** | (2006.01) |
| ***C22C 38/24*** | (2006.01) |
| ***C22C 38/26*** | (2006.01) |
| ***C21D 8/00*** | (2006.01) |

(52) U.S. Cl.

CPC ..... *C22C 38/38* (2013.01); *C21D 8/005* (2013.01); *C22C 38/001* (2013.01); *C22C 38/02* (2013.01); *C22C 38/06* (2013.01); *C22C 38/20* (2013.01); *C22C 38/24* (2013.01); *C22C 38/26* (2013.01); *C21D 2211/005* (2013.01)

(58) Field of Classification Search

CPC ..... C22C 38/38; C22C 38/001; C22C 38/02; C22C 38/06; C22C 38/20; C22C 38/04; C22C 38/26; C21D 2211/005

USPC ..... 420/90

See application file for complete search history.

(56) References Cited

U.S. PATENT DOCUMENTS

2015/0259771 A1* 9/2015 Vartanov ..... C21D 9/32 148/318

FOREIGN PATENT DOCUMENTS

| | | | |
|---|---|---|---|
| JP | 60262941 | A | 12/1985 |
| JP | 11256267 | A | 9/1999 |
| JP | 2008274393 | A | 11/2008 |

OTHER PUBLICATIONS

ISR issued in Int'l. Application No. PCT/JP2018/040570, dated Jan. 22, 2019.

* cited by examiner

*Primary Examiner* — Humera N. Sheikh
*Assistant Examiner* — Katherine A Christy
(74) *Attorney, Agent, or Firm* — Greer, Burns & Crain, Ltd.

(57) ABSTRACT

A hot forged steel material in the present embodiment includes a chemical composition that consists of, in mass %, C: 0.14 to 0.20%, Si: 0.20 to 1.00%, Mn: 1.00 to 1.90%, P: 0.030% or less, S: 0.030% or less, V: 0.16 to 0.30%, Al: 0.015 to 0.050%, N: 0.0050 to 0.0250%, Cr: 0.10 to 0.30%, Cu: 0 to 0.10%, and Nb: 0 to 0.10%, with the balance being Fe and impurities, and that satisfies Formula (1) and Formula (2), wherein a grain size number of ferrite in the steel is 9.0 or more, and an absorbed energy at −30° C. is 100 J or more in the Charpy impact test using a V notch specimen.

$$0.36 \leq C+(Si+Mn)/6+(Cr+V)/5+Cu/15 < 0.68 \quad (1)$$

$$51/12 \times C - V \leq 0.52 \quad (2)$$

4 Claims, No Drawings

HOT FORGED STEEL MATERIAL

This is a National Phase Application filed under 35 U.S.C. § 371, of International Application No. PCT/JP2018/040570, filed Oct. 31, 2018, the contents of which are incorporated by reference.

TECHNICAL FIELD

The present disclosure relates to a steel material, more specifically to a hot forged steel material, which is a steel material subjected to hot forging.

BACKGROUND ART

For a frame of a machine product such as a plunger pia a large steel-made part is used.

Such a large steel-made part is generally produced by the following producing method. A thick plate made of a steel for machine structure is prepared. The prepared thick plate is subjected to cutting machining to produce a plurality of intermediate steel materials. Between the plurality of intermediate steel materials produced by performing the cutting machining on the thick plate, support ribs are sandwiched, and the support ribs and the intermediate steel materials are welded together, by which the plurality of intermediate steel materials are connected together. Through the above processes, the steel-made part is produced.

As described above, in a case where intermediate steel materials are produced by performing the cutting machining on the thick plate, the intermediate steel materials and the support ribs are welded together to produce steel-made part. This case involves a large number of welding steps.

In contrast, in a case where hot forged steel materials, which are made by subjecting steel materials to hot forging, are used as intermediate steel materials, a hot forged steel material into which support ribs and the intermediate steel materials are integrally formed can be produced. Using hot forged steel materials enables the process of welding support ribs and intermediate steel materials to be reduced, thereby reducing a number of welding steps in producing a steel-made part. Moreover, since the support ribs and the intermediate steel materials are integrally formed, strengths of connection portions between the support ribs and the intermediate steel materials are increased. It is therefore preferable to produce a steel-made part using hot forged steel materials produced by hot forging.

In a case where a steel-made part is produced using a hot forged steel material, the hot forged steel material is required to have a high tensile strength and a high toughness. In addition, a machine product such as a plunger pump may be used in cold climate areas. For those reasons, hot forged steel materials for steel-made part are particularly required to have a high tensile strength as well as an excellent low-temperature toughness.

A steel for steel-made part is disclosed in, for example, Japanese Patent Application Publication No. 11-256267 (Patent Literature 1) and Japanese Patent Application Publication No. 60-262941 (Patent Literature 2).

A steel material for structure described in Patent Literature 1 includes a chemical composition consisting of, in mass percent, C: 0.04 to 0.18%, Si: 0.60% or less, Mn: 0.80 to 1.80%, P: 0.030% or less, S: 0.015% or less, V: 0.04 to 0.15%, and N: 0.0050 to 0.0150%, additionally containing one or two of Al: 0.005 to 0.050% and Ti: 0.005 to 0.050%, with the balance being Fe and impurities, and satisfying the following formula: $0.34 \leq C+Si/24+Mn/6+V/14+Ni/40+Cr/5+Mo/4 \leq 0.48\%$. This steel material for structure further includes a structure that contains 0.02 to 0.07% of VN precipitates and in which VN precipitates have particle sizes from 5 to 200 nm and precipitate at $10^6$ to $10^{10}/mm^3$. In this steel material for structure, ferrite has a grain size of no. 5 or more in grain size number specified in JIS G 0552, and an area fraction of ferrite grains ranges from 50 to 100%. Patent Literature 1 describes that, with the configuration described above, this steel material for structure has an excellent fracture toughness under high strain rate deformation.

A steel for warm forging described in Patent Literature 2 is one made by performing hot working on a steel consisting of, in mass percent, C: 0.1 to 0.5%, Si: 0.03 to 1.0%, Mn: 0.2 to 2.0%, Al: 0.015 to 0.07%, and N: 0.009 to 0.03%, with the balance being Fe and impurities, and its grains at a time of reheating such as normalizing, carburizing, and carbonitriding after warm forging at 300 to 950° C. are fine uniform grains being no. 6 or more in grain size number. Patent Literature 2 describes that the configuration described above enables this steel for warm forging to increase a strength of a part.

CITATION LIST

Patent Literature

Patent Literature 1: Japanese Patent Application Publication No. 11-256267

Patent Literature 2: Japanese Patent Application Publication No. 60-262941

SUMMARY OF INVENTION

Technical Problem

However, as far as the present inventors refer to Examples of Patent Literature 1 (see Table 2-1 and Table 2-2), grain size numbers of ferrites of steel materials for structure according to Patent Literature 1 are as low as 7.5 or less. Therefore, the steel materials for structure may be low in low-temperature toughness. Furthermore, according to Patent Literature 1, a high tensile strength may not be obtained in some cases where a rate of strain in a tensile test is a normal one, about 0.2 mm/s.

In Patent Literature 2, the forging temperature for the steel for warm forging is as low as 950° C. or less. Therefore, a high tensile strength and a high low-temperature toughness are not obtained in some cases.

It is known that a high low-temperature toughness is obtained when Ni and a rare earth metal are contained. However, these elements are expensive, increasing a production cost. Thus, there is a demand for a hot forged steel material that has a high strength and an excellent low-temperature toughness even when these elements are not contained or when contents of these elements are limited to low contents.

An objective of the present disclosure is to provide a hot forged steel material that as a high strength and an excellent low-temperature toughness.

Solution to Problem

A hot forged steel material according to the present disclosure includes a chemical composition consisting of, in mass %, C: 0.14 to 0.20%, Si: 0.20 to 1.00%, Mn: 1.00 to 1.90%, P: 0.030% or less, S: 0.030% or less, V: 0.16 to 0.30%, Al: 0.015 to 0.050%, N: 0.0050 to 0.0250%, Cr: 0.10 to 0.30%, Cu: 0 to 0.10%, and Nb: 0 to 0.10%, with the balance being Fe and impurities, and satisfying Formula (1) and Formula (2), wherein a grain size number of ferrite in the hot forged steel material is 9.0 or more, and an absorbed energy at −30° C. is 100 J or more in the Charpy impact test using a V notch specimen:

$$0.36 \leq C+(Si+Mn)/6+(Cr+V)/5+Cu/15<0.68 \quad (1)$$

$$51/12 \times C-V \leq 0.52 \quad (2)$$

where symbols of elements in Formula (1) and Formula (2) are to be substituted by contents of corresponding elements (mass %).

Advantageous Effects of Invention

The hot forged steel material according to the present disclosure has strength and a high low-temperature toughness.

DESCRIPTION OF EMBODIMENTS

The present inventors conducted investigations and studies for increasing a strength and a low-temperature toughness of a hot forged steel material used for a large steel-made part. As a result, the present inventors first considered that a weldability of the steel material is increased by setting a low C content. As a consequence of further studies, the present inventors considered that a hot forged steel material including a chemical composition that consists of, in mass percent, C: 0.14 to 0.20%, Si: 0.20 to 1.00%, Mn: 1.00 to 1.90%, P: 0.030% or less, S: 0.030% or less, V: 0.16 to 0.30%, Al: 0.015 to 0.050%, N: 0.0050 to 0.0250%, Cr: 0.10 to 0.30%, Cu: 0 to 0.10%, and Nb: 0 to 0.10%, with the balance being Fe and impurities has a possibility of increasing both its strength and low-temperature toughness.

However, there was a case where a sufficient strength was not obtained only by simply adjusting the chemical composition of the hot forged steel material to the chemical composition shown above with the low C content. The present inventors thus conducted further studies. As a result, it was found that the strength is increased when the chemical composition shown above additionally satisfies the following Formula (1):

$$0.36 \leq C+(Si+Mn)/6+(Cr+V)/5+Cu/15<0.68 \quad (1)$$

where, symbols of elements in Formula (1) are to be substituted by contents of the corresponding elements (in mass %).

Let F1 be defined as F1=C+(Si+Mn)/6+(Cr+V)/5+Cu/15. F1 is an index of weldability and strength and corresponds to carbon equivalent. When F1 is 0.36 or more, a sufficient strength is obtained even with the chemical composition shown above. It is generally known that the lower the carbon equivalent, the more excellent the weldability. Accordingly, F1 is set at less than 0.68 for the steel material in the present embodiment having the chemical composition shown above. It is considered in this case that an excellent weldability is obtained as compared with a case where F1 is 0.68 or more. In addition, when F1 is less than 0.68, bainite is difficult to produce in a microstructure, which increases the low-temperature toughness.

Additionally, in the hot forged steel material in the present embodiment, 0.16 to 0.30% of V is contained to cause fine V carbo-nitrides and the like (VC, VN, and V(C, N) or composite precipitates of VC, VN, and V(C, N) and other elements) to precipitate, as shown in the chemical composition shown above. The present inventors considered that, by satisfying Formula (1) and setting a V content at 0.16 to 0.30% as shown in chemical composition shown above to cause the fine V carbo-nitrides and the like to precipitate, a tensile strength TS of the hot forged steel material becomes 600 MPa or more, which means a high strength is obtained.

It was however found that, in a case where Formula (1) is satisfied, and the V content is set at 0.16 to 0.30% in the chemical composition shown above, although a high strength is obtained, the low-temperature toughness of the hot forged steel material was low in some cases. Hence, the present inventors further conducted studies about a hot forged steel material that provides not only a sufficient strength but also a sufficient low-temperature toughness. As a result, the present inventors found that the strength as well as the low-temperature toughness can be increased when the chemical composition shown above satisfies Formula (1) as well as Formula (2):

$$51/12 \times C-V \leq 0.52 \quad (2)$$

where, symbols of elements in Formula (2) are to be substituted by contents of corresponding elements (mass %).

Let F2 be defined as F2=51/12×C−V. F2 is an index of an amount of C remaining in a dissolved state in the hot forged steel material after the precipitation of the V carbo-nitrides (hereinafter, referred to as amount of dissolved C). If F2 is more than 0.52, the amount of dissolved C in a steel material is excessively large even after the V carbo-nitrides and the like precipitate. In this case, the low-temperature toughness of the hot forged steel material is decreased. In the chemical composition shown above, when Formula (1) is satisfied, and F2 is 0.52 or less, the amount of dissolved C after the V carbo-nitrides and the like precipitate is sufficiently suppressed, and as a result, the low-temperature toughness of the hot forged steel material is increased. Specifically, in the Charpy impact test using a V notch specimen, an absorbed energy at −30° C. of the hot forged steel material is 100 J or more, provided that a grain size number conforming to JIS G 0551(2013) of ferrite grains, which will be described below, is 9.0 or more.

In the hot forged steel material described above, its low-temperature toughness is further increased by refining grains of ferrite (pro-eutectoid ferrite). Specifically, when a grain size numbers conforming to JIS G 0551(2013) of the ferrite grains is 9.0 or more, an excellent low-temperature toughness is obtained.

In a case where hot forging is performed, ferrite grains after the hot forging are coarse grains. Thus, for the hot forged steel material according to the present invention, 0.015 to 0.050% of Al and 0.0050 to 0.0250% of N are contained as shown in the chemical composition shown above, and normalizing treatment is performed at, for example, 875 to 950° C. In this case, the normalizing treatment refines the ferrite grains, and in addition, the ferrite grains are further refined by the pinning effect brought by AlN that is formed in the normalizing treatment. Note that TiN. V carbo-nitrides, and the like are very fine, and they do not exert the pinning effect. To refine the ferrite grains during the normalizing treatment, the pinning effect by the AlN is effective.

In the present invention, Ti and Mo are impurities. Ti forms TiN, decreasing the low-temperature toughness of the hot forged steel material. Mo forms bainite in the steel, decreasing the low-temperature toughness of the hot forged steel material. For that reason, Ti and Mo are impurities.

A hot forged steel material in the present embodiment that is completed based on the findings described above includes a chemical composition that consists of, in mass %, C: 0.14 to 0.20%, Si: 0.20 to 1.000%, Mn: 1.00 to 1.90%, P: 0.030% or less, S: 0.030% or less, V: 0.16 to 0.30%, Al: 0.015 to 0.050%, N: 0.0050 to 0.0250%, Cr: 0.10 to 0.30%, Cu: 0 to 0.10%, and Nb: 0 to 0.10%, with the balance being Fe and impurities, and that satisfies Formula (1) and Formula (2), wherein a grain size number of ferrite in the hot forged steel material is 9.0 or more, and an absorbed energy at −30° C. is 100 J or more in the Charpy impact test using a V notch specimen:

$$0.36 \leq C+(Si+Mn)/6+(Cr+V)/5+Cu/15<0.68 \quad (1)$$

$$51/12 \times C-V \leq 0.52 \quad (2)$$

where, symbols of elements in Formula (1) and Formula (2) are to be substituted by contents of corresponding elements (mass %).

The chemical composition shown above may contain one or more selected from the group consisting of Cu: 0.01 to 0.10% and Nb: 0.01 to 0.10%.

The hot forged steel material in the present embodiment may have a tensile strength TS of 600 MPa or more.

The hot forged steel material according to the present invention will be described below in detail. The sign "%" following each element indicates mass percent unless otherwise noted.

[Chemical Composition]

The chemical composition of the hot forged steel material in the present embodiment contains the following elements.

C: 0.14 to 0.20%

Carbon (C) increases the tensile strength of the steel material. If a C content is less than 0.14%, this effect cannot be obtained sufficiently even when the other element contents fall within respective ranges in the present embodiment. In contrast, if the C content is more than 0.20%, the weldability and the low-temperature toughness of the steel material are decreased even when the other element contents fall within respective ranges in the present embodiment.

Accordingly, the C content ranges from 0.14 to 0.20%. A lower limit of the C content is preferably more than 0.14%, more preferably 0.15%, and still more preferably 0.16%. An upper limit of the C content is preferably 0.19%, more preferably 0.18%, and still more preferably 0.17%.

Si: 0.20 to 1.00%

Silicon (Si) deoxidizes steel. In addition, Si is dissolved in ferrite in the steel material and strengthens ferrite, increasing the strength of the steel material. If a Si content is less than 0.20%, these effects cannot be obtained sufficiently even when the other element contents fall within respective ranges in the present embodiment. In contrast, if the Si content is more than 1.00%, scales tend to remain on a surface of the hot forged steel material, degrading appearance properties of the hot forged steel material. Accordingly, the Si content ranges from 0.20 to 1.00%. A lower limit of the Si content is preferably 0.30%, more preferably 0.40%, and still more preferably 0.500%. An upper limit of the Si content is preferably 0.90%, more preferably 0.80%, and still more preferably 0.70%.

Mn: 1.00 to 1.90%

Manganese (Mn) deoxidizes steel. In addition, Mn is dissolved in the steel material, increasing the strength of the steel material. If a Mn content is less than 1.00%, these effects cannot be obtained sufficiently even when the other element contents fall within respective ranges in the present embodiment. In contrast, if the Mn content is more than 1.90%, bainite is produced in the steel material, decreasing the low-temperature toughness of the hot forged steel material even when the other elements fall within respective ranges in the present embodiment. Accordingly, the Mn content ranges from 1.00 to 1.90%. A lower limit of the Mn content is preferably 1.20%, more preferably 1.30%, and still more preferably 1.40%. An upper limit of the Mn content is preferably less than 1.90%, more preferably 1.80%, still more preferably 1.70%, and still more preferably 1.60%.

P: 0.030% or less

Phosphorus (P) is an impurity contained unavoidably. That is, a P content is more than 0%. If the P content is more than 0.030%, P segregates in grain boundaries in the steel material, making the steel material brittle even when the other element contents fall within respective ranges in the present embodiment.

Accordingly, the P content is 0.030% or less. An upper limit of the P content is preferably 0.020%, more preferably 0.015%, and still more preferably 0.010%. The P content is preferably as low as possible. However, if the P content is excessively reduced in a steelmaking process, the production cost increases, and a productivity decreases. Accordingly, a lower limit of the P content is preferably 0.001%, and more preferably 0.002%.

S: 0.030% or less

Sulfur (S) is an impurity contained unavoidably. That is, a S content is more than 0%. If the S content is more than 0.030%, S decreases a hot workability of the steel material even when the other element contents fall within respective ranges in the present embodiment. Accordingly, the S content is 0.030% or less. An upper limit of the S content is preferably 0.020%, more preferably 0.015%, and still more preferably 0.013%. The S content is preferably as low as possible. However, if the S content is excessively reduced in the steelmaking process, the production cost increases, and the productivity decreases. Accordingly, a lower limit of the S content is preferably 0.001%, and more preferably 0.002%.

V: 0.16 to 0.30%

Vanadium (V) binds with carbon and/or nitrogen to form fine V carbo-nitrides and the like (VC, VN, and V(C, N) or composite precipitates of VC, VN, and V(C, N) and other elements), increasing the strength of the hot forged steel material. If a V content is less than 0.16%, this effect cannot be obtained sufficiently even when the other element contents fall within respective ranges in the present embodiment. In contrast, if the V content is more than 0.30%, coarse V carbo-nitrides and the like are produced even when the other element contents fall within respective ranges in the present embodiment. The coarse V carbo-nitrides and the like decrease the low-temperature toughness of the hot forged steel material. Accordingly, the V content ranges from 0.16 to 0.30%. A lower limit of the V content is preferably 0.17%, more preferably 0.18%, still more preferably 0.19%, and still more preferably 0.20%. An upper limit of the V content is preferably 0.29%, more preferably 0.28%, still more preferably 0.27%, and still more preferably 0.26%.

Al: 0.015 to 0.050%

Aluminum (Al) deoxidizes steel. In addition, Al forms AlN, refining ferrite grains of the hot forged steel material by the pinning effect. This increases the low-temperature toughness of the hot forged steel material. If an Al content is less than 0.015%, these effects cannot be obtained sufficiently even when the other element contents fall within respective ranges in the present embodiment. In contrast, if the Al content is more than 0.050%, coarse $Al_2O_3$-based inclusions and coarse AlN tend to be produced even when the other element contents fall within respective ranges in the present embodiment. The coarse $Al_2O_3$-based inclusions and the coarse AlN decrease the low-temperature toughness of the hot forged steel material. Accordingly, the Al content ranges from 0.015 to 0.050%. A lower limit of the Al content is preferably 0.016%, more preferably 0.018%, and still more preferably 0.020%. An upper limit of the Al content is preferably 0.040%, more preferably 0.035%, and still more preferably 0.030%. The term "Al" content used herein means a content of "acid-soluble Al," that is, "sol.Al."

N: 0.0050 to 0.0250%

Nitride (N) binds with Al and V to form AlN, V carbo-nitrides, and the like. AlN refines the ferrite grains of the hot forged steel material by the pinning effect, increasing the low-temperature toughness of the hot forged steel material. The V carbo-nitrides and the like increase the strength of the hot forged steel material by precipitation strengthening. If a N content is less than 0.0050%, these effects cannot be obtained sufficiently even when the other element contents fall within respective ranges in the present embodiment. In contrast, if the N content is more than 0.0250%, coarse AlN and coarse V carbo-nitrides are produced, decreasing the low-temperature toughness of the hot forged steel material. Accordingly, the N content ranges from 0.0050 to 0.0250%. A lower limit of the N content is preferably 0.0060%, more preferably 0.0070%, still more preferably 0.0080%, and still more preferably 0.0090%. An upper limit of the N content is preferably 0.0220%, more preferably 0.0210%, still more preferably 0.0200%, still more preferably 0.0190%, and still more preferably 0.0180%.

Cr: 0.10 to 0.30%

Chromium (Cr) increases the strength of the steel material. If a Cr content is less than 0.10%, this effect cannot be obtained sufficiently even when the other element contents fall within respective ranges in the present embodiment. In contrast, if the Cr content is more than 0.30%, the low-temperature toughness and the weldability of the steel material are decreased even when the other element contents fall within respective ranges in the present embodiment. Accordingly, the Cr content ranges from 0.10 to 0.30%. A lower limit of the Cr content is preferably 0.12%, more preferably 0.15%, and still more preferably 0.16%. An upper limit of the Cr content is preferably 0.25%, more preferably 0.22%, and still more preferably 0.20%.

The balance of the chemical composition of the hot forged steel material in the present embodiment is Fe and impurities. Here, the impurities refer to those that are mixed from ores and scraps used as raw materials, a production environment, or the like in producing the hot forged steel material in an industrial manner, and are allowed to be mixed in the hot forged steel material within ranges in which the impurities have no adverse effect on the hot forged steel material according to the present invention.

In the hot forged steel material in the present embodiment, examples of the impurities include Ti and Mo. Ti forms TiN. TiN decreases the low-temperature toughness of the hot forged steel material significantly. When Mo is contained, bainite tends to be produced in the steel material after the normalizing treatment. As a result, the low-temperature toughness of the steel material is decreased. For the hot forged steel material in the present embodiment, Ti and Mo decrease the low-temperature toughness of the hot forged steel material. Accordingly, the lower a Ti content and a Mo content, the more preferable they are, and the Ti content and the Mo content may be 0%. In the present embodiment, the Ti content is 0.010% or less. The Mo content is 0.10% or less. The Ti content and the Mo content are adjustable to the respective ranges shown above as long as one who possesses the common general technical knowledge in this field produces the steel material through a producing process described below. An upper limit of the Ti content is preferably 0.008%, more preferably 0.005%, and still more preferably less than 0.003%. An upper limit of the Mo content is preferably 0.09%, and more preferably 0.08%.

[Optional Elements]

The chemical composition of the hot forged steel material shown above may further contain one or more selected from the group consisting of Cu and Nb, in lieu of a part of Fe. Both of these elements are optional elements and increase the strength of the hot forged steel material.

Cu: 0 to 0.10%

Copper (Cu) is an optional element and need not be contained. That is, a Cu content may be 0%. When contained, Cu increases the strength of the hot forged steel material. Even a trace amount of Cu can provide the above effect to some extent. However, if the Cu content is more than 0.10%, the hot workability of the hot forged steel material is decreased even when the other element contents fall within respective ranges in the present embodiment. Accordingly, the Cu content is 0 to 0.10%. A lower limit of the Cu content is preferably more than 0%, more preferably 0.01%, and still more preferably 0.02%. An upper limit of the Cu content is preferably 0.08%, more preferably 0.07%, and still more preferably 0.05%.

Nb: 0 to 0.10%

Niobium (Nb) is an optional element and need not be contained. That is, a Nb content may be 0%. When contained, Nb binds with carbon and/or nitrogen in grains to form fine Nb carbo-nitrides and the like (NbC, NbN, and Nb(C, N) or composite precipitates of NbC, NbN, and Nb(C, N) and other elements), increasing the strength of the hot forged steel material by the precipitation strengthening. Even a trace amount of Nb can provide the above effect to some extent. Note that, regarding the chemical composition of the hot forged steel material in the present embodiment, the Nb carbo-nitrides and the like described above tend not to contribute to grain refinement of the ferrite grains. In contrast, if the Nb content is more than 0.10%, coarse Nb carbo-nitrides and the like are produced, decreasing the low-temperature toughness of the hot forged steel material even when the other element contents fall within respective ranges in the present embodiment. Accordingly, the Nb content is 0 to 0.10%. A lower limit of the Nb content is preferably more than 0%, more preferably 0.01%, and still more preferably 0.02%. An upper limit of the Nb content is preferably 0.08%, and more preferably 0.05%.

[Formula (1)]

The chemical composition of the hot forged steel material in the present embodiment further satisfies Formula (1):

$$0.36 \leq C+(Si+Mn)/6+(Cr+V)/5+Cu/15<0.68 \quad (1)$$

where, symbols of elements in Formula (1) are to be substituted by contents of the corresponding elements (mass percent).

Let F1 be defined as F1=C+(Si+Mn)/6+(Cr+V)/5+Cu/15. F1 is an index of the strength of the hot forged steel material and corresponds to carbon equivalent. If F1 is less than 0.36, the strength of the hot forged steel material becomes insufficient. Specifically, even when the element contents in the chemical composition fall within the respective ranges shown above and satisfy Formula (2), the tensile strength of the hot forged steel material becomes less than 600 MPa. It is generally known that the lower the carbon equivalent, the more excellent the weldability. In order not to decrease the weldability excessively, an upper limit of F1 is set at less than 0.68. If F1 is 0.68 or more, bainite is produced in a microstructure, which makes the hot forged steel material excessively hard. As a result, the low-temperature toughness is decreased. When F1 is 0.36 to less than 0.68, the element contents of the chemical composition fall within the respective ranges shown in the present embodiment, and provided that Formula (2) is satisfied, a tensile strength of 600 MPa or more is obtained, and an excellent low-temperature toughness is obtained. A lower limit of F1 is preferably 0.40, more preferably 0.45, and still more preferably 0.50. An upper limit of F1 is preferably 0.65, more preferably 0.63, and still more preferably 0.61. F1 is rounded off to two decimal places.

[Formula (2)]

The chemical composition of the hot forged steel material in the present embodiment further satisfies Formula (2):

$$51/12\times C-V\leq 0.52 \quad (2)$$

where, symbols of elements in Formula (2) are to be substituted by contents of corresponding elements (mass percent).

Let F2 be defined as F2=51/12×C−V. F2 is an index relating to an amount of dissolved C remaining in the steel material after the precipitation of the V carbo-nitrides in the hot forged steel material. In F2, "51" means an atomic weight of V, and "12" means anatomic weight of C. If F2 is more than 0.52, the amount of dissolved C remaining in the steel is excessively large even after the V carbo-nitrides and the like precipitate. In this case, the low-temperature toughness of the hot forged steel material is decreased. In the chemical composition shown above, when Formula (1) is satisfied, and F2 is 0.52 or less, the amount of dissolved C in the steel material after the V carbo-nitrides and the like precipitate is sufficiently small, and therefore the low-temperature toughness of the hot forged steel material is increased. As a result, an absorbed energy at −30° C. is 100 J or more in the Charpy impact test using a V notch specimen, provided that the element contents in the chemical composition fall within the respective ranges shown in the present embodiment, the chemical composition satisfies Formula (1), and a grain size number of ferrite in a microstructure is 9.0 or more.

An upper limit of F2 is preferably 0.50, more preferably 0.49, and still more preferably 0.48. A lower limit of F2 is not limited to a specific value. However, with consideration given to the lower-limit value of the C content and the upper-limit value of the V content in the chemical composition shown above, the lower limit of F2 is preferably 0.30, and more preferably 0.32.

[Microstructure]

A microstructure (matrix structure) of the hot forged steel material according to the present invention is constituted by ferrite and pearlite. The ferrite referred to herein means pro-eutectoid ferrite unless otherwise noted. As long as the microstructure is constituted by ferrite and pearlite, an excellent low-temperature toughness of the hot forged steel material is obtained, provided that the element contents in the chemical composition fall within the ranges shown in the present embodiment, and the chemical composition satisfies Formula (1) and Formula (2). In the hot forged steel material in the present embodiment, when the respective element contents in the chemical composition fall within the respective ranges shown in the present embodiment, and the chemical composition satisfies Formula (1) and Formula (2), the microstructure constituted by ferrite and pearlite can be obtained provided that a producing method described below is performed. Note that the microstructure described in the present specification means a structure of what is called matrix (base metal), from which precipitates and inclusions are eliminated. The microstructure constituted by ferrite and pearlite herein means that a total area fraction of the ferrite and the pearlite acquired according to a measurement method described below performed on phases in the microstructure is 95.0% or more.

[Method for Measuring Phases in Microstructure]

Phases (ferrite, pearlite, etc.) in a microstructure can be identified by the following method.

A sample is taken from a given portion at a depth of 5 mm or deeper from a surface of the hot forged steel material. A size of the sample is not limited to a specified size as long as an observation field described below can be secured. A surface of the sample (observation surface) is subjected to mirror polish and then etched by an ethanol solution containing 2% of nitric acid in volume fraction (Nital etching reagent). On the etched observation surface, structure observation is conducted. The structure observation is conducted under an optical microscope with 100× magnification, with the observation field set at 200 μm×200 μm. A given visual field in the observation surface is observed. In the observation field, phases (ferrite, pearlite, bainite, etc.) have their own different contrasts. Therefore, the phases are identified based on their respective contrasts. From the identified phases, a total area of ferrite and a total area of pearlite are determined. A ratio of a sum of the total area of ferrite and the total area of pearlite with respect to a total area of the observation field (hereinafter, referred to as total area fraction of ferrite and pearlite) is determined. When the total area fraction of ferrite and pearlite is 95.0% or more, the microstructure is recognized as a microstructure constituted by ferrite and pearlite.

[Grain Size]

Additionally, in the hot forged steel material in the present embodiment, a grain size number specified in JIS G 0551 (2013) of ferrite in its microstructure is 9.0 or more. Since the grain size number of the ferrite is 9.0 or more, which indicates that the ferrite is fine, and thus the hot forging steel material in the present embodiment is excellent in low-temperature toughness. Specifically, in the Charpy impact test using a V notch specimen, an absorbed energy at −30° C. is 100 J or more.

In the hot forged steel material in the present embodiment, a lower limit of the grain size number conforming to JIS G 0551 (2013) of the ferrite in its microstructure is preferably 9.5, and more preferably 10.0. An upper limit of the grain size number conforming to JIS G 0551 (2013) of the ferrite in the microstructure is not limited to a specific number, but in a case of the chemical composition shown above satisfying Formula (1) and Formula (2), the upper limit of the grain size number is, for example, 15.0 or may be 14.5. Note that, as described above, the grain size number of the ferrite specified in the present embodiment means a grain size number of pro-eutectoid ferrite and does not mean a grain size number of ferrite in pearlite.

[Method for Measuring Grain Size Number]

A grain size number of ferrite in a microstructure is determined by the following method. A sample is taken from within a zone ranging from a depth of 3.0 mm to a depth of 20.0 mm from the surface of the hot forged steel material. A size of the sample is not limited to a specified size as long as a visual field described below can be secured. One of surfaces of the sample is specified as an observation surface, subjected to mirror polish, and then etched by an ethanol solution containing 2% of nitric acid in volume fraction (Nital etching reagent), by which grain boundaries of ferrite grains are caused to appear on the observation surface. In each of given ten visual fields (each having an area of 40 $mm^2$) within the etched observation surface each including ferrite, a grain size number of the ferrite grains is determined. Specifically, the grain size number of the ferrite grains in each visual field is determined by comparison with a grain size number standard chart specified in 7.2 of JIS G 0551 (2013). An average of the grain size numbers of the respective visual fields is defined as a grain size number of the hot forged steel material in the present embodiment. The grain size number is a value obtained by rounding off the average to one decimal place (that is, a numeric value of the grain size number of the ferrite grains has one decimal place).

[Low-Temperature Toughness]

The hot forged steel material in the present embodiment has an absorbed energy at −30° C. of 100 J or more in the Charpy impact test using a V notch specimen conforming to JIS Z 2242 (2005). Since the hot forged steel material in the present embodiment includes the microstructure constituted by ferrite and pearlite and has 9.0 or more of a grain size number conforming to JIS G 0551 (2013) of ferrite in its microstructure, the hot forged steel material shows an absorbed energy at −30° C. of 100 J or more in the Charpy impact test described above, providing an excellent low-temperature toughness. For the hot forged steel material in the present embodiment, a lower limit of the absorbed energy at −30° C. in the Charpy impact test using a V notch specimen conforming to JIS Z 2242 (2005) is preferably 105 J or more, and more preferably 115 J or more.

[Method for Measuring Low-Temperature Toughness]

The low-temperature toughness of the hot forged steel material in the present embodiment can be measured by the following method. V notch specimens specified in JIS Z 2242 (2005) are taken from within a zone ranging from a depth of 3.0 mm to a depth of 20.0 mm from the surface of the hot forged steel material. The V notch specimens each have a cross section of being a 10 mm×10 mm square and a length in a longitudinal direction of 55 mm. That is, the V notch specimens are each what is called a full-size test specimen. That is, full-size test specimens are taken from within the zone described above ranging from the depth of 3.0 mm to the depth of 20.0 mm from the surface of the hot forged steel material. The longitudinal direction of the V notch specimens is parallel to an axial direction (longitudinal direction) of the hot forged steel material. A V notch is formed at a length-center position of each V notch specimen (i.e., a center position of the 55 mm length). A V notch angle is 45°, a notch depth is 2 mm, and a notch root radius is 0.25 mm. Using the V notch specimens, the Charpy impact test conforming to JIS Z 2242 (2005) is conducted to determine the absorbed energy at −30° C. Specifically, the Charpy impact test conforming to JIS Z 2242 (2005) is conducted in the atmosphere on three V notch specimens cooled to −30° C., and an average of resultant absorbed energies is defined as the absorbed energy at −30° C. (J). The absorbed energy (J) is an integral value made by rounding off the average to a nearest integer.

[Tensile Strength]

A tensile strength of the hot forged steel material in the present embodiment is 600 MPa or more. In the hot forged steel material in the present embodiment, a large number of fine V carbo-nitrides and the like precipitate in its ferrite by interphase boundary precipitation. The hot forged steel material in the present embodiment therefore has a high tensile strength. Sizes of the fine V carbo-nitrides and the like in the ferrite are at nanoscale, and it is thus extremely difficult to quantitatively measure a surface number density (/$\mu m^2$) of the fine V carbo-nitrides and the like in the ferrite. Hence, for the hot forged steel material in the present embodiment, a degree of precipitation of the fine V carbo-nitrides and the like is replaced with a definition of tensile strength.

A lower limit of the tensile strength of the hot forged steel material in the present embodiment is preferably 605 MPa, and more preferably 610 MPa. An upper limit of the tensile strength of the hot forged steel material in the present embodiment is not limited to a specific tensile strength, but in the case of the chemical composition shown above, the upper limit of the tensile strength is, for example, 750 MPa.

[Method for Measuring Tensile Strength]

The tensile strength of the hot forged steel material in the present embodiment can be measured by the following method. From within a zone ranging from a depth of 3.0 mm to a depth of 20.0 mm from the surface of the hot forged steel material, a round-bar tensile test specimen having a diameter of 6.35 mm and a parallel portion length of 35 mm is fabricated. The parallel portion of the round-bar tensile test specimen is parallel to the axial direction (longitudinal direction) of the hot forged steel material. Using the round-bar tensile test specimen, a tensile test is conducted at a normal temperature (10 to 35° C.) in the atmosphere in conformity with JIS Z 2241 (2011), by which the tensile strength (MPa) is obtained. A rate of strain of the tensile test is 0.2 mm/s.

[Usage of Hot Forged Steel Material]

The hot forged steel material in the present embodiment is widely applicable to usage in which a strength and a low-temperature toughness are demanded. The hot forged steel material is applied to, for example, a steel-made part that is produced by welding. Examples of the steel-made part include a frame member of industrial equipment typified by a plunger pump. In a case where the hot forged steel material is applied to the frame member of the industrial equipment, a frame (housing) of the industrial equipment can be produced by, for example, combining a plurality of hot forged steel materials and fixing neighboring hot forged steel materials by welding or the like.

[Producing Method]

An example of a method for producing the hot forged steel material in the present embodiment will be described. Note that the producing method is not limited to the following producing method as long as the hot forged steel material in the present embodiment has the configuration shown above. The producing method described below is still a preferable example of producing the hot forged steel material in the present embodiment.

The method for producing the hot forged steel material includes a step of preparing a starting material (preparing step), a step of performing hot forging on the starting material (hot forging step), and a step of performing normalizing treatment on the hot forged starting material to produce the hot forged steel material (normalizing treatment step). The steps will be described below in detail.

[Preparing Step]

A molten steel having a chemical composition in which element contents fall within the respective ranges shown in the present embodiment above and that satisfies Formula (1) and Formula (2) is produced. The molten steel is used to produce the starting material. Specifically, the molten steel is used to produce a slab or a bloom through a continuous casting process. Using the molten steel, an ingot may be produced through an ingot-making process. The slab, bloom, or ingot may be subjected to blooming to be produced into a billet, as necessary. Through the above step, the starting material (slab, bloom, ingot, or billet) is produced. In a case where the blooming is performed, a heating temperature of the slab, bloom, or ingot before the blooming can be within a well-known temperature range (e.g., 1050 to 1300° C.).

[Hot Forging Step]

The prepared starting material is subjected to hot forging to be produced into an intermediate product in a rough shape. A heating temperature at a time of the hot forging ranges 1200 to 1300° C. The starting material is heated in, for example, a reheating furnace. Here, the heating temperature during the hot forging corresponds to a surface temperature of the starting material at a time of starting the hot forging. The heating temperature during the hot forging can be measured using, for example, a thermometer disposed at an outlet of the reheating furnace.

By setting the heating temperature during the hot forging at 1200 to 1300° C., the V carbo-nitrides and the like in the starting material can be dissolved sufficiently. In a case where the V carbo-nitrides in the starting material can be dissolved sufficiently by the heating during the hot forging, fine V carbo-nitrides and the like can be dispersed and caused to precipitate in ferrite (pro-eutectoid ferrite) through interphase boundary precipitation in a cooling step after the hot forging. If the heating temperature during the hot forging is less than 1200° C., the V carbo-nitrides and the like are not dissolved sufficiently but remain in the steel material after the heating during the hot forging. In this case, the V carbo-nitrides and the like remaining in the starting material coarsen in the cooling step after the hot forging and in the normalizing treatment in a downstream step of the hot forging step. As a result, this decreases the low-temperature toughness of the hot forged steel material, which decreases the absorbed energy at −30° C. to less than 100 J in the Charpy impact test using a V notch specimen. In contrast, if the temperature of the hot forging is excessively high, the production cost increases. Accordingly, the temperature of the hot forging ranges from 1200 to 1300° C. The hot forging may be performed a plurality of times. In a case where the hot forging is performed a plurality of times, it is sufficient that a temperature of the hot forging during a final hot forging ranges from 1200 to 1300° C. The intermediate product subjected to the hot forging is allowed to cool. A rate of the allowing cooling is, for example, 3 to 50° C./min. In this case, the V carbo-nitrides and the like are restrained from coarsening in the cooling, and hard structures such as bainite are restrained from being produced in the microstructure.

[Normalizing Treatment Step]

In the normalizing treatment step, normalizing treatment is performed on the intermediate product subjected to the hot forging. Through the normalizing treatment, the grain size number of ferrite in the steel material is brought to 9.0 or more. A temperature of the normalizing treatment (normalizing temperature) is the $A_{c3}$ transformation point or higher, specifically 875 to 950° C. By setting the normalizing temperature within the range shown above, the V carbo-nitrides and the like are partially dissolved again in the normalizing treatment and subjected to the interphase boundary precipitation again in the cooling. In this case, fine V carbo-nitrides and the like are produced, which restrains growth of coarse V carbo-nitrides and the like. As a result, the tensile strength TS of the hot forged steel material becomes 600 MPa or more. A retention time at the normalizing temperature shown above is not limited to a specific retention time but, for example, 40 to 150 minutes.

In the normalizing treatment, the ferrite grains are refined. In addition, in the hot forged steel material having the chemical composition in the present embodiment, fine AlN is produced within the normalizing temperature range shown above. Therefore, not only the normalizing treatment but also the pinning effect brought by AlN produced at the normalizing treatment further refines the ferrite grains. Specifically, the normalizing treatment described above brings the grain size number of the ferrite grain to 9.0 or more and provides an excellent low-temperature toughness to the hot forged steel material having the chemical composition satisfying Formula (1) and Formula (2) shown above; specifically, the hot forged steel material shows an absorbed energy at −30° C. of 100 J or more in the Charpy impact test using a V notch specimen.

Through the above steps, the hot forged steel material in the present embodiment is produced. Note that the producing method described above is merely an example of the method for producing the hot forged steel material in the present embodiment, and the method for producing the hot forged steel material in the present embodiment is not limited to the producing method described above. The hot forged steel material in the present embodiment having the configuration described above may be produced by another method different from the producing method described above.

The produced hot forged steel material may be subjected to machining or the like. The produced hot forged steel material may be used as a frame member: a steel-made part such as a frame (housing) of industrial equipment such as a plunger pump can be produced by welding a plurality of hot forged steel materials.

EXAMPLE

Starting materials (round bars measuring 80 to 100 mm in diameter) having chemical compositions shown in Table 1 were prepared.

TABLE 1

| Test | Chemical Composition (mass %, balance being Fe and impurities) | | | | | | | | | | | |
|---|---|---|---|---|---|---|---|---|---|---|---|---|
| No. | C | Si | Mn | P | S | V | Al | N | Cr | Cu | No | Mo |
| 1 | 0.17 | 0.58 | 1.48 | 0.006 | 0.010 | 0.26 | 0.038 | 0.0215 | 0.15 | 0.04 | 0.03 | — |
| 2 | 0.17 | 0.59 | 1.49 | 0.006 | 0.010 | 0.26 | 0.036 | 0.0204 | 0.15 | 0.04 | — | — |
| 3 | 0.15 | 0.60 | 1.39 | 0.008 | 0.011 | 0.23 | 0.023 | 0.0122 | 0.18 | 0.04 | — | — |
| 4 | 0.16 | 0.61 | 1.40 | 0.009 | 0.010 | 0.23 | 0.021 | 0.0206 | 0.18 | 0.04 | — | — |
| 5 | 0.17 | 0.58 | 1.48 | 0.006 | 0.010 | 0.26 | 0.038 | 0.0192 | 0.15 | — | — | — |
| 6 | 0.16 | 0.58 | 1.50 | 0.006 | 0.010 | 0.26 | 0.035 | 0.0198 | 0.15 | — | 0.03 | — |

TABLE 1-continued

| | | | | | | | | | | | | |
|---|---|---|---|---|---|---|---|---|---|---|---|---|
| 7 | 0.12 | 0.60 | 1.41 | 0.008 | 0.010 | 0.28 | 0.019 | 0.0160 | 0.17 | 0.03 | — | — |
| 8 | 0.15 | 0.60 | 1.97 | 0.008 | 0.010 | 0.14 | 0.019 | 0.0120 | 0.18 | 0.04 | — | — |
| 9 | 0.14 | 0.61 | 1.38 | 0.008 | 0.011 | 0.12 | 0.022 | 0.0111 | 0.18 | 0.04 | — | — |
| 10 | 0.16 | 0.60 | 1.40 | 0.008 | 0.010 | 0.01 | 0.021 | 0.0146 | 0.18 | 0.03 | — | 0.18 |
| 11 | 0.18 | 0.60 | 1.58 | 0.006 | 0.010 | 0.26 | 0.035 | 0.0029 | 0.20 | 0.05 | — | — |
| 12 | 0.17 | 0.67 | 1.64 | 0.010 | 0.004 | 0.17 | 0.011 | 0.0088 | 0.20 | 0.02 | — | — |
| 13 | 0.18 | 0.60 | 1.82 | 0.010 | 0.005 | 0.26 | 0.033 | 0.0213 | 0.20 | 0.05 | — | — |
| 14 | 0.18 | 0.58 | 1.51 | 0.006 | 0.006 | 0.26 | 0.028 | 0.0191 | 0.14 | 0.01 | — | — |
| 15 | 0.17 | 0.60 | 1.69 | 0.002 | 0.001 | 0.19 | 0.022 | 0.0174 | 0.16 | 0.01 | — | — |

| Test No. | F1 | F2 | Heating Temperature at Hot Forging (° C.) | Microstructure | Grain Size Number | Weldability | Tensile Strength TS (MPa) | Absorbed Energy at −30° C. (J) |
|---|---|---|---|---|---|---|---|---|
| 1 | 0.60 | 0.46 | 1250 | F + P | 10.0 | ○ | 649 | 106 |
| 2 | 0.60 | 0.46 | 1250 | F + P | 10.0 | ○ | 658 | 122 |
| 3 | 0.57 | 0.41 | 1250 | F + P | 10.0 | ○ | 605 | 145 |
| 4 | 0.58 | 0.45 | 1250 | F + P | 10.0 | ○ | 608 | 153 |
| 5 | 0.60 | 0.46 | 1250 | F + P | 10.0 | ○ | 642 | 130 |
| 6 | 0.59 | 0.42 | 1250 | F + P | 10.0 | ○ | 630 | 118 |
| 7 | 0.55 | 0.23 | 1250 | F + P | 10.0 | ○ | 584 | 194 |
| 8 | 0.65 | 0.50 | 1250 | F + P + B | 10.0 | ○ | 789 | 23 |
| 9 | 0.53 | 0.48 | 1250 | F + P | 10.0 | ○ | 570 | 169 |
| 10 | 0.53 | 0.67 | 1250 | F + P + B | 10.0 | ○ | 660 | 27 |
| 11 | 0.64 | 0.51 | 1250 | F + P | 6.0 | ○ | 733 | 11 |
| 12 | 0.63 | 0.55 | 1250 | F + P | 7.5 | ○ | 658 | 42 |
| 13 | 0.68 | 0.51 | 1250 | F + P + B | 10.0 | x | 804 | 17 |
| 14 | 0.61 | 0.51 | 650 | F + P | 10.0 | ○ | 612 | 12 |
| 15 | 0.62 | 0.53 | 1250 | F + P | 10.0 | ○ | 660 | 82 |

Signs "–" seen in Table 1 each indicate that an element content of a corresponding element is less than a detection limit of the element. A column "F1" in Table 1 shows F1 values of test numbers. When an F1 value of a test number was less than 0.68, a weldability of the test number was determined to be excellent, and "○" was marked in a corresponding column "weldability" in Table 1. When the F1 value took the other values, the weldability of the test number was determined to be poor, and "×" was marked in the corresponding column "weldability." A column "F2" in Table 1 shows F2 values of test numbers.

The hot forging (hot cogging) was performed on the round bars being the starting materials described above to produce intermediate products (round bars measuring 60 mm in diameter). The heating temperatures of the starting materials (round bars) during the hot forging (corresponding to the temperature at the time of starting the hot forging) were as shown in Table 1. The intermediate products subjected to the hot forging were allowed to cool to the normal temperature at 3 to 50° C./min. The normalizing treatment was performed on the intermediate products allowed to cool. In the normalizing treatment, the temperature (normalizing temperature) ranged from 875 to 950° C., and the retention time ranged from 60 to 120 minutes. Through the above steps, the hot forged steel materials were produced.

[Evaluation Tests]

[Microstructure Observation Test]

A sample was taken from within a zone ranging from a depth of 3.0 mm to a depth of 20.0 mm from a surface of a hot forged steel material of each test number. A surface of the sample (observation surface) was subjected to mirror polish and then etched by an ethanol solution containing 2% of nitric acid in volume fraction (Nital etching reagent). On the etched observation surface, the structure observation was conducted. The structure observation was conducted under an optical microscope with 100× magnification, with the visual field set at 200 μm×200 μm. A given visual field in the observation surface was observed. In the observation field, phases (ferrite, pearlite, bainite, etc.) have their own different contrasts. Therefore, the phases were identified based on their respective contrasts. From the identified phases, a total area of ferrite and a total area of pearlite were determined. A ratio of a sum of the total area of ferrite and the total area of pearlite with respect to a total area of the observation field (total area fraction of ferrite and pearlite) was determined. When the total area fraction of ferrite and pearlite was 95.0% or more, the microstructure was recognized as a microstructure constituted by ferrite and pearlite. In Table 1, "F+P" shown in a column "microstructure" indicates that a corresponding microstructure was a structure constituted by ferrite and pearlite. In contrast, when the total area fraction of ferrite and pearlite was less than 95.0%, and ferrite and pearlite as well as bainite were observed, the microstructure was determined not to be a structure constituted by ferrite and pearlite. In Table 1, "F+P+B" shown in the column "microstructure" indicates that the total area fraction of ferrite and pearlite in a corresponding microstructure was less than 95.0%, and the microstructure was a structure containing ferrite, pearlite, and bainite.

[Test for Measuring Grain Size Number]

A sample was taken from within a zone ranging from a depth of 3.0 mm to a depth of 20.0 mm from the surface of the hot forged steel material of each test number. The observation surface of the sample was subjected to mirror polish, and then etched by an ethanol solution containing 2% of nitric acid in volume fraction (Nital etching reagent), by which grain boundaries of ferrite were caused to appear on the observation surface. In each of given ten visual fields (each having an area of 40 $mm^2$) within the etched observation surface each including ferrite, a grain size number of the ferrite in each visual field was determined. Specifically, the grain size number of the ferrite in each visual field was determined by comparison with a grain size number standard chart specified in 7.2 of JIS G 0551 (2013). An average of the grain size numbers of the respective visual fields was defined as a grain size number of the hot forged steel material in the present embodiment. The grain size number was determined as a value obtained by rounding off the average to one decimal place.

[Tensile Strength Test]

From within a zone ranging from a depth of 3.0 mm to a depth of 20.0 mm from the surface of the hot forged steel material of each test number, a round-bar tensile test specimen having a diameter of 6.35 mm and a parallel portion length of 35 mm was fabricated. The parallel portion of the round-bar tensile test specimen was parallel to the axial direction of the hot forged steel material. Using the round-bar tensile test specimen, the tensile test was conducted at the normal temperature (10 to 35° C.) in the atmosphere in conformity with JIS Z 2241 (2011), by which the tensile strength TS (MPa) was obtained. The rate of strain of the tensile test was 0.2 mm/s. When the tensile strength TS was 600 MPa or more, the hot forged steel material was evaluated to have a high tensile strength.

[Charpy Impact Test]

V notch specimens specified in JIS Z 2242 (2005) were fabricated from within a zone ranging from a depth of 3.0 mm to a depth of 20.0 mm from the surface of the hot forged steel material of each test number. The V notch specimens each had a cross section being a 10 mm×10 mm square and a length in a longitudinal direction of 55 mm. The longitudinal direction of the V notch specimens was parallel to the axial direction (longitudinal direction) of the hot forged steel material. A V notch was formed at a length-center position of each V notch specimen (i.e., a center position of the 55 mm length). A V notch angle was 45°, a notch depth was 2 mm, and a notch root radius was 0.25 mm. Using the V notch specimens, the Charpy impact test conforming to JIS Z 2242 (2005) was conducted to determine the absorbed energy at −30° C. Specifically, the Charpy impact test conforming to JIS Z 2242 (2005) was conducted in the atmosphere on three V notch specimens cooled to −30° C., and an average of resultant absorbed energies was defined as the absorbed energy at −30° C. (J). The absorbed energy (J) was an integral value made by rounding off the average to a nearest integer.

[Test Results]

Table 1 shows results of the tests.

Referring to Table 1, in Test No. 1 to Test No. 6, chemical compositions of their hot forged steel materials were appropriate. In addition, their F1s were 0.36 to less than 0.68. Furthermore, their F2s were 0.52 or less, and grain size numbers of ferrite in their steel materials were 9.0 or more. Accordingly, their tensile strengths TS were 600 MPa or more, showing high strengths, and their absorbed energies at −30° C. were 100 J or more, showing excellent low-temperature toughnesses.

In contrast, a hot forged steel material of Test No. 7 had a low C content. As a result, its tensile strength TS was less than 600 MPa, showing a low strength.

A hot forged steel material of Test No. 8 had a high Mn content and a low V content, and therefore bainite was produced in a microstructure of the hot forged steel material. As a result, its absorbed energy at −30° C. was less than 100 J, showing that the low-temperature toughness is low.

A hot forged steel material of Test No. 9 had a low V content. Accordingly, its tensile strength TS was less than 600 MPa, showing a low strength.

A hot forged steel material of Test No. 10 had a low V content and contained Mo. Therefore, bainite was produced in its microstructure. As a result, its absorbed energy at −30° C. was less than 100 J, showing that the low-temperature toughness is low.

A hot forged steel material of Test No. 11 had a low N content. Accordingly, a grain size number of its ferrite grains was less than 9.0. As a result, its absorbed energy at −30° C. was less than 100 J, showing that the low-temperature toughness is low.

A hot forged steel material of Test No. 12 had a low Al content. In addition, its F2 did not satisfy Formula (2). Accordingly, its grain size number was less than 9.0. As a result, its absorbed energy at −30° C. was less than 100 J, showing that the low-temperature toughness is low.

A hot forged steel material of Test No. 13 showed F1 that was 0.68 or more. Therefore, its weldability was considered to be low. In addition, bainite was produced in its microstructure. As a result, its absorbed energy at −30° C. was less than 100 J, showing that the low-temperature toughness is low.

For a hot forged steel material of Test No. 14, the heating temperature during the hot forging was less than 1200° C. As a result, its absorbed energy at −30° C. was less than 100 J. It is considered that the low heating temperature during the hot forging caused the V carbo-nitrides and the like remaining after the heating in the hot forging to coarsen in the normalizing treatment step, which results in a decrease in low-temperature toughness.

Regarding a hot forged steel material of Test No. 15, F2 did not satisfy Formula (2). As a result, its absorbed energy at −30° C. was less than 100 J. It is considered that a large amount of dissolved C in the steel material after the normalizing treatment process caused a decrease in low-temperature toughness.

The embodiment according to the present invention has been described above. However, the embodiment described above is merely an example of practicing the present invention. The present invention is therefore not limited to the embodiment described above, and the embodiment described above can be modified and practiced as appropriate without departing from the scope of the present invention.

The invention claimed is:

1. A hot forged steel material comprising a chemical composition consisting of, in mass %:

C: 0.14 to 0.20%;
Si: 0.20 to 1.00%;
Mn: 1.00 to 1.90%;
P: 0.030% or less;
S: 0.030% or less;
V: 0.16 to 0.30%;
Al: 0.015 to 0.050%;
N: 0.0050 to 0.0250%;
Cr: 0.10 to 0.30%;
Cu: 0 to 0.10%; and
Nb: 0 to 0.10%, with the balance being Fe and impurities, and satisfying Formula (1) and Formula (2), wherein a total area fraction of ferrite and pearlite in a microstructure in the hot forged steel material is 95.0% or more, a grain size number of ferrite specified in JIS G 0551 (2013) in the hot forged steel material is 9.0 or more, and an absorbed energy at −30° C. is 100 J or more in the Charpy impact test conforming to JIS Z 2242(2005) using a V notch specimen:

$$0.36 \leq C+(Si+Mn)/6+(Cr+V)/5+Cu/15<0.68 \quad (1)$$

$$51/12 \times C-V \leq 0.52 \quad (2),$$

where symbols of elements in Formula (1) and Formula (2) are to be substituted by contents of corresponding elements (mass %).

2. The hot forged steel material according to claim 1, wherein the chemical composition contains one or more selected from the group consisting of Cu: 0.01 to 0.10% and Nb: 0.01 to 0.10%.

3. The hot forged steel material according to claim 1, wherein a tensile strength TS conforming to JIS Z 2241 (2011) is 600 MPa or more.

4. The hot forged steel material according to claim 2, wherein a tensile strength TS conforming to JIS Z 2241 (2011) is 600 MPa or more.

* * * * *